US006626154B1

(12) United States Patent
Kanno

(10) Patent No.: US 6,626,154 B1
(45) Date of Patent: Sep. 30, 2003

(54) FUEL INJECTION CONTROL FOR ENGINE

(75) Inventor: Isao Kanno, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 156 days.

(21) Appl. No.: 09/705,157

(22) Filed: Nov. 2, 2000

(30) Foreign Application Priority Data

Nov. 2, 1999 (JP) ..... 11-313035

(51) Int. Cl.[7] ..... F02M 51/00
(52) U.S. Cl. ..... 123/486; 123/462; 123/480
(58) Field of Search ..... 123/462, 463, 123/480, 486, 490, 674, 683–685

(56) References Cited

U.S. PATENT DOCUMENTS

| | | | | |
|---|---|---|---|---|
| 4,911,130 A | * | 3/1990 | Takahashi et al. | 123/683 |
| 4,936,278 A | * | 6/1990 | Umeda | 123/683 |
| 5,219,398 A | | 6/1993 | Nonaka et al. | |
| 5,241,939 A | | 9/1993 | Nonaka | |
| RE34,803 E | | 12/1994 | Chasteen | |
| 5,375,578 A | | 12/1994 | Kato et al. | |
| 5,404,858 A | | 4/1995 | Kato | |
| 5,476,426 A | | 12/1995 | Nakamura et al. | |
| 5,586,524 A | | 12/1996 | Nonaka et al. | |
| 5,586,544 A | * | 12/1996 | Kitamura et al. | 123/480 |
| 5,613,480 A | | 3/1997 | Katoh et al. | |
| 5,655,500 A | | 8/1997 | Kato | |
| 5,673,676 A | | 10/1997 | Mukumoto | |
| 5,682,867 A | | 11/1997 | Katoh et al. | |
| 5,697,353 A | | 12/1997 | Katoh et al. | |
| 5,715,796 A | * | 2/1998 | Suzuki et al. | 257/371 |
| 5,724,951 A | | 3/1998 | Mukumoto | |
| 5,769,053 A | | 6/1998 | Nonaka | |
| 5,813,374 A | | 9/1998 | Chasteen | |
| 5,813,390 A | | 9/1998 | Anamoto | |
| 6,062,202 A | | 5/2000 | Chasteen | |
| 6,067,957 A | | 5/2000 | Motose et al. | |
| 6,116,228 A | | 9/2000 | Motose et al. | |
| 6,286,492 B1 | * | 9/2001 | Kanno | 123/684 |

FOREIGN PATENT DOCUMENTS

| | | |
|---|---|---|
| JP | 59-49337 | 3/1984 |

* cited by examiner

*Primary Examiner*—John Kwon
(74) *Attorney, Agent, or Firm*—Knobbe, Martens, Olson & Bear LLP.

(57) ABSTRACT

A fuel injection control for an engine includes an improved construction that can hold an accurate atmospheric pressure data during and after starting of the engine. The engine includes an air intake passage. A throttle valve is moveably disposed within the air intake passage. A first sensor is arranged to sense an opening degree of the throttle valve. A fuel injector is arranged to spray fuel toward a combustion chamber of the engine. A control unit is configured to determine an amount of the fuel at least based upon an opening degree data sensed by the first sensor. A second sensor is primarily arranged to sense an intake pressure of the air flowing through the air intake passage. The second sensor is positioned downstream the throttle valve. The control unit adjusts a fuel amount based upon a reference data corresponding to an atmospheric pressure. The control unit includes a non-volatile memory for storing the intake pressure data as the reference data when the control unit starts operating and the engine stands still.

24 Claims, 8 Drawing Sheets

Control Map For Determining Fuel Amount (Amn)

Large ↑

Engine Speed (Cn)

| | | | | |
|---|---|---|---|---|
| C1 | A11 | --- | --- | Am1 |
| C2 | A12 | | | ⋮ |
| ⋮ | ⋮ | | | ⋮ |
| ⋮ | ⋮ | | | ⋮ |
| ⋮ | ⋮ | | | ⋮ |
| Cn | A1n | --- | --- | Amn |
| | K1 | --- | --- | Km |

→ Large

Throttle Opening Degree (Km)

*Figure 6*

FUEL INJECTION CONTROL FOR ENGINE

PRIORITY INFORMATION

This application is based on and claims priority to Japanese Patent Application No. Hei 11-313035, filed Nov. 2, 1999, the entire contents of which is hereby expressly incorporated by reference.

BACKGROUND OF THE INVENTION

1. Field of the Invention

This invention relates to a fuel injection system for an engine, and more particularly to an apparatus and a method for controlling a fuel injection system of an engine.

2. Description of Related Art

In all fields of engine design, there is an increasing emphasis on obtaining more effective emission control, better fuel economy and, at the same time, increasing power output. This trend has resulted in the substitution of fuel injection systems for carburetors as the engine charge former.

Fuel injection systems typically inject fuel into an air intake passage(s) or directly into a combustion chamber(s). An ECU (electronic control unit) can control the fuel injection systems. The ECU typically controls an amount of the fuel. In some configurations, an engine speed sensor and a throttle valve position sensor are provided and respective signals from these sensors are used for determining suitable fuel amounts during operation of the engine. The fuel amounts can be defined in a control map stored in the control unit and can depend upon both engine speed and throttle valve position.

The signal from the throttle position sensor represents an amount of air or air flow rate introduced into the combustion chamber(s). The air amount, however, varies due to changes in the atmospheric pressure. For instance, the atmospheric pressure at higher elevations is lower than that at sea level. Thus, the air amount introduced into the air intake passage (s) at the higher elevations is inevitably smaller even though the throttle valve is placed in the same position. It is necessary therefore to adjust data relating to the air amount with data reflecting atmospheric pressure when effectively controlling fuel injection.

SUMMARY OF THE INVENTION

Conventional control systems may include an atmospheric pressure sensor. The control systems, however, are equipped with a number of other sensors for more accurate control of the engine. An intake pressure sensor is one of the sensors. This sensor senses an air intake pressure in the intake passage(s) during operation of the engine. Because the function of the intake pressure sensor is similar to that of the atmospheric pressure sensor, the intake pressure sensor can be used as the atmospheric pressure sensor. This is advantageous because at least one sensor, i.e., the atmospheric pressure sensor, can be omitted.

The idea is realized by providing a memory, for example, RAM, in the ECU to store a signal from the intake pressure sensor as an atmospheric pressure signal when the ECU starts operating but the engine stands still.

Additionally, many engines use a starter motor to crank or start themselves. The starter motor consumes a relatively large amount of power while cranking and hence a voltage supplied by the battery momentary falls during this period of time. FIG. 7 illustrates this situation. When the starter motor starts cranking, the battery voltage can abruptly drop to a level lower than a reset voltage of the ECU. The situation is likely to occur particularly when the engine is started under a cold condition. Once this happens, the ECU erroneously takes again the current intake pressure as the atmospheric pressure when it restarts operating. At this very moment, the intake pressure likely will be less than the actual atmospheric pressure because a negative pressure is generated due to the intake stroke of the engine. Accordingly, the injected fuel amount can deviate from the optimum amount and the engine operation can deteriorate. It is anticipated that this deviation will result in a leaner than desired mixture.

A need therefore exists for a fuel injection control that can hold an accurate atmospheric pressure during and after starting of the engine notwithstanding using an intake pressure sensor as an atmospheric pressure sensor.

In accordance with one aspect of the present invention, an internal combustion engine comprises a cylinder block defining at least one cylinder bore. A piston reciprocates within the cylinder bore. A cylinder head closes an end of the cylinder bore to define a combustion chamber together with the cylinder bore and the piston. An air induction system is arranged to introduce air to the combustion chamber. The air induction system includes an air intake passage. A throttle valve is moveably disposed within the air intake passage for admitting the air in proportion to an opening degree thereof. A first sensor is arranged to sense the opening degree to send out an opening degree data. A fuel injector is arranged to spray fuel toward the combustion chamber. A control unit is configured to determine an amount of the fuel at least based upon the opening degree data. A second sensor is primarily arranged to sense an intake pressure of the air flowing through the air intake passage to send out an intake pressure data. The second sensor is positioned downstream the throttle valve. The control unit adjusts the amount of the fuel based upon a reference data corresponding to an atmospheric pressure. The control unit includes a non-volatile memory for storing the intake pressure data as the reference data when the control unit starts operating and the engine stands still.

In accordance with another aspect of the present invention, an internal combustion engine comprises a cylinder block defining at least one cylinder bore. A piston reciprocates within the cylinder bore. A cylinder head closes an end of the cylinder bore to define a combustion chamber together with the cylinder bore and the piston. An air induction system is arranged to introduce air to the combustion chamber. The air induction system includes an air intake passage. A throttle valve is moveably disposed within the air intake passage for admitting the air in proportion to an opening degree thereof. A first sensor is arranged to sense the opening degree to send out an opening degree data. A fuel injector is arranged to spray fuel toward the combustion chamber. A control unit is configured to determine an amount of the fuel at least based upon the opening degree data. A second sensor is primarily arranged to sense an intake pressure of the air flowing through the air intake passage to send out an intake pressure data. The second sensor is positioned downstream the throttle valve. The control unit adjusts the amount of the fuel based upon a reference data corresponding to an atmospheric pressure. The control unit includes means for storing the intake pressure data as the reference data when the control unit starts operating and the engine stands still.

In accordance with a further aspect of the present invention, a control method is provided for an engine. The engine includes a fuel injector, an air intake passage having a throttle valve and a control unit having a non-volatile memory. The control method comprises sensing an air pressure in the intake passage under a standstill condition of the engine. Storing a data of the air pressure in the non-volatile memory is provided. Sensing an opening degree of the throttle valve under an operating condition of the engine is provided. Determining a first control data at least based upon a data of the opening degree is provided. Adjusting the first control data with a second control data corresponding to the data of the air pressure stored in the non-volatile memory is provided. Controlling the fuel injector based upon the adjusted first control data is provided.

Further aspects, features and advantages of this invention will become apparent from the detailed description of the preferred embodiment which follows.

BRIEF DESCRIPTION OF THE DRAWINGS

These and other features, aspects and advantages of the present invention will now be described with reference to the drawings of a preferred embodiment which is intended to illustrate and not to limit the invention. The drawings comprise eight figures.

FIG. 6 is an exemplary control map used by the illustrated control unit. The horizontal axis indicates throttle valve opening degree or position, while the vertical axis indicates engine speed. Each square of the figure indicates an amount of fuel injected by a fuel injector.

DETAILED DESCRIPTION OF THE PREFERRED EMBODIMENT OF THE INVENTION

Figure 1:
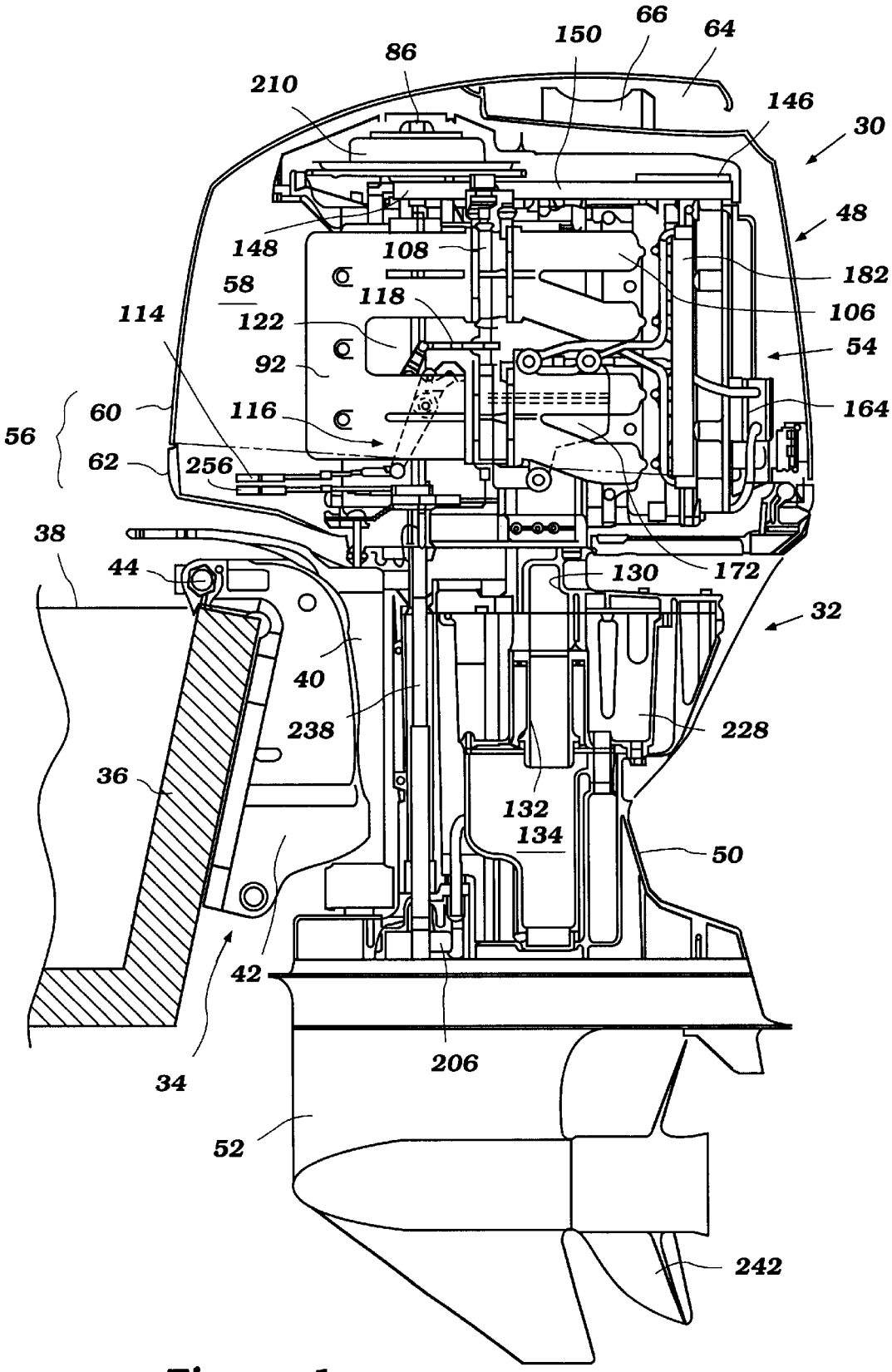
FIG. 1 is a side elevation wire frame view of an outboard motor that employs a fuel injection control system configured in accordance with certain features, aspects and advantages of the present invention. An associated watercraft is partially illustrated.

With reference to FIGS. 1–5, an overall construction of an outboard motor 30, which employs a control system arranged and configured in accordance with certain features, aspects and advantages of the present invention, will be described. Although the present invention is shown in the context of an outboard motor engine, various features, aspects and advantages of the present invention also can be employed with engines used in other types of marine drives (e.g., a stern drive unit and in-board/outboard drives) and also, for example, with engines used in land vehicles (i.e., motorcycles, snowmobiles and all terrain vehicles) and stationary engines (i.e., generators).

In the illustrated arrangement, the outboard motor 30 comprises a drive unit 32 and a bracket assembly 34. The bracket assembly 34 supports the drive unit 32 on a transom 36 of an associated watercraft 38. The drive unit 32 preferably is disposed such that a marine propulsion device is placed in a submerged position with the watercraft 38 resting on the surface of a body of water. The bracket assembly 34 preferably comprises a swivel bracket 40, a clamping bracket 42, a steering shaft and a pivot pin 44.

As is known, the steering shaft typically extends through the swivel bracket 40 and is affixed to the drive unit 32. The steering shaft is journaled for steering movement about a generally vertically extending steering axis, which is defined within the swivel bracket 40.

The clamping bracket 34 preferably includes a pair of bracket arms that are spaced apart from each other and that are affixed to the watercraft transom 36. The pivot pin 44 completes a hinge coupling between the swivel bracket 40 and the clamping bracket 42. The pivot pin 44 extends through the bracket arms so that the clamping bracket 42 supports the swivel bracket 40 for pivotal movement about a generally horizontally extending tilt axis, which is defined by the pivot pin 44. The illustrated drive unit 32 thus can be tilted or trimmed about the pivot pin 44.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context use.

A hydraulic tilt and trim adjustment system preferably extends between the swivel bracket 40 and the clamping bracket 42 to raise or lower the swivel bracket 40 and the drive unit 32 relative to the clamping bracket 34. In other arrangements, the outboard motor 30 can have a manually operated system for raising and lowering the drive unit 32.

The illustrated drive unit 32 includes a power head 48, a driveshaft housing 50 and a lower unit 52. The power head 48 is disposed atop the drive unit 32 and includes an internal combustion engine 54, which is positioned within a protective cowling 56. The protective cowling 56 in the illustrated arrangement defines a generally closed engine compartment 58. The protective cowling 56 preferably comprises a top cowling member 60 and a bottom cowling member 62. The top cowling member 60 can be detachably affixed to the bottom cowling 62 so that the operator can access the engine 54 for maintenance or other purposes.

The top cowling 60 preferably comprises a pair of air intake compartments 64 at both rear sides thereof. Each compartment 64 has an air duct 66 that extends generally vertically in the compartment 64. The air intake compartments 64 communicate with the closed cavity 58 through the air ducts 66 so that an ambient air can be introduced into the cavity 58 and to the engine 54 for combustion.

The engine 54 preferably operates on a four-stroke combustion principle. The illustrated engine 54 comprises a cylinder block 70 that defines four cylinder bores 72. The cylinder bores 72 are generally horizontally extending and are vertically spaced from one another. This type of engine, however, is exemplary of an engine on which various features, aspects and advantages of the present invention can be used. Engines having other number of cylinder bores, having other cylinder arrangements and operating on other combustion principles (e.g., two-stroke crankcase combustion or rotary) all can use at least some of the features, aspects or advantages described herein.

A piston 76 can reciprocate in each cylinder bore 72. In the illustrated arrangement, a cylinder head assembly 78 is affixed to one end of the cylinder block 70 and, together with the pistons 76 and the cylinder bores 72, defines four combustion chambers 80. A crankcase member preferably closes the other end of the cylinder block 70. Together, the cylinder block 70 and the crankcase member 82 at least partially define a crankcase chamber 84. A crankshaft 86 extends generally vertically through the crankcase chamber 84. The crankshaft 86 preferably is connected to the pistons 76 by connecting rods 88 and is rotated by the reciprocal movement of the pistons 76. In the illustrated arrangement, the crankcase member 82 is located at the most forward position with the cylinder block 70 and the cylinder head assembly 78 extends rearward from the crankcase member 82. These components preferably are mounted in seriatim.

The engine 54 includes an air induction system 88 through which air is introduced into the combustion chambers 80. The induction system 88 preferably includes a plenum chamber 92, four air intake passages 94 and eight intake ports 96. As will be recognized, the number of intake passages and ports can vary. The intake ports 96 are defined in the cylinder head assembly 78. In the illustrated arrangement, two of the intake ports 96 are associated with a single intake passage 94 and both of the intake ports 96 open into a single combustion chamber 80.

The intake ports 96 are repeatedly opened and closed by intake valves 98. When intake ports 96 are opened, the respective intake passages 94 communicate with the associated combustion chambers 80.

The plenum chamber 92 functions as an intake silencer and/or a coordinator of air charges. In the illustrated arrangement, a plenum chamber member 100 defines the plenum chamber 92 and is mounted on the port side of the crankcase member 82. The plenum chamber member 92 preferably has an air inlet opening (not shown) that opens to the closed cavity 58. The illustrated intake passages 94 extend rearwardly from the plenum chamber member 100 along the cylinder block 70 on the port side and then bend toward the intake ports 96. Air is taken into the plenum chamber 92 from the cavity or engine compartment through the inlet opening. The air then is introduced into the combustion chambers 80 through the intake passages 94 and the intake ports 80.

The illustrated intake passages 94 are defined by intake ducts 104, which are preferably formed with the plenum chamber member 100, intake manifolds 106 connected to the associated intake ports 96 and throttle bodies 108 interposed between the intake ducts 104 and the intake manifolds 106. In the illustrated arrangement, the respective throttle bodies 108 support butterfly-type throttle valves 110 in a manner that allows pivotal movement of the valves 110 about axes defined by valve shafts that extend generally vertically. The valve shafts preferably are linked together to form a single valve shaft assembly 112 that passes through all of the throttle bodies 108.

The valve shaft assembly 112 can be operable by the watercraft operator through a suitable mechanism including a throttle cable 114, a non-linear linkage 116, a control lever 118 and a bias spring 120. In the illustrated arrangement, the control lever 118 and the bias spring 120 generally are placed in a space 122 defined between the two upper intake passages 94 and the two lower intake passages 94. When the operator operates the throttle cable 114, the mechanism actuates the valve shaft assembly 112 to open the throttle valves 110. Conversely, when the throttle cable 114 is released, the mechanism actuates the valve shaft assembly 112 to close the throttle valves 110. Preferably, the spring 120 operates to close the valves when the opening force provided by the cable 114 is removed or reduced. A rapid closing of the throttle valve, as used herein, occurs when the valves are closed by the restorative force of the spring 120 without any opening biasing force provided by the throttle cable 114.

Figure 2:
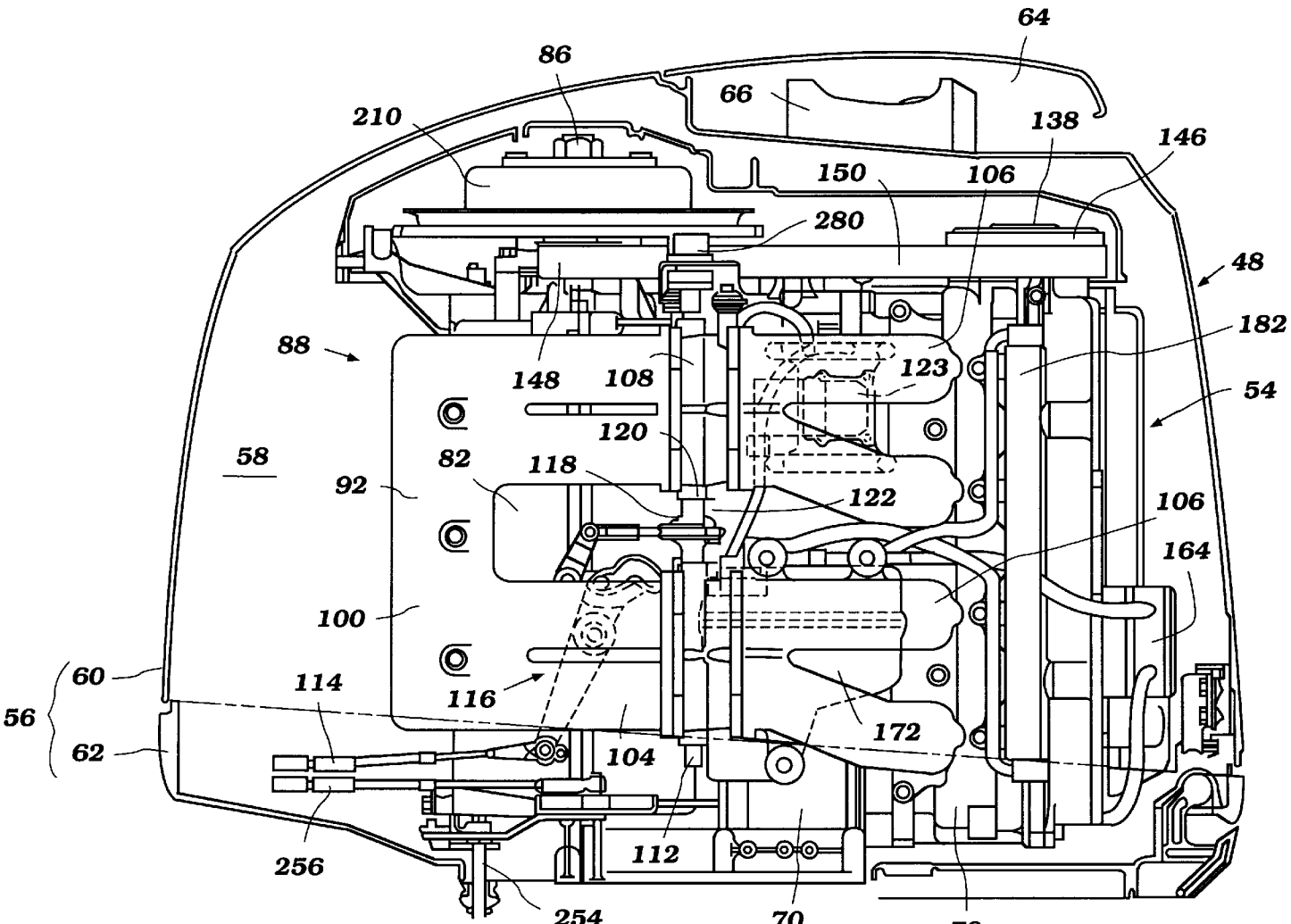
FIG. 2 is an enlarged side view of a power head. A protective cowling is shown in section.

The throttle valves 110, thus, admit a proper amount of air into the intake passages 94 in proportion to an opening degree or opening position thereof. In other words, a certain amount of air measured by the throttle valves 110 is introduced into the combustion chambers 80 through the intake passages 94. Under a normal running condition, the larger the amount of the air, the higher the speed of the engine operation. When the throttle valves 110 are in a generally closed position, the opening degree at this position is defined as zero degrees. The throttle valves 110 preferably do not reach completely close, even in the zero position, and movement of the throttle valves 110 preferably stops at approximately one degree position so as to allow a small amount of air still flowing there. This amount of air can keep the engine operation in an idle state. In addition, small holes can be formed in the throttle valve 110 or a bypass passage can be arranged to allow a small level of air flow even if the throttle valves are completely closed. In order to maintain idle speed, an idle air adjustment unit 123 can be additionally provided. This alternative induction system is shown in FIG. 2. An auxiliary passage is coupled with one of the intake passages 94 to bypass the throttle valve 110. The auxiliary passage can have an idle air adjustment valve. An opening degree of the adjustment valve preferably is controlled electrically by, for example, an ECU which will be described later.

The engine 54 also preferably includes an exhaust system that directs burnt air-fuel charges or exhaust gases to a location outside of the outboard motor 30. A set of exhaust ports 124 are defined in the cylinder head assembly 78 and are repeatedly opened and closed by a corresponding set of exhaust valves 126. When the exhaust ports 124 are opened, the combustion chambers 80 communicate with an exhaust manifold 128 which collects the exhaust gases and directs them away from the combustion chambers 80. The exhaust gases, in major part, are discharged into the body of water surrounding the outboard motor 30 through an exhaust passage 130 formed in an exhaust guide member, on which the engine 54 is mounted, an exhaust pipe 132 and an exhaust expansion chamber 134, which are formed in the driveshaft housing 50, and other internal passages formed in the lower unit 52.

An intake camshaft 138 and an exhaust camshaft 140 are journaled for rotation and extend generally vertically in the cylinder head assembly 78. The intake camshaft 138 actuates the intake valves 98 while the exhaust camshaft 140 actuates the exhaust valves 126. The camshafts 138, 140 have cam lobes 142 thereon to push the respective valves 98, 126. The associated ports 96, 124 are thus opened and closed repeatedly.

Preferably, the crankshaft 86 drives the camshafts 138, 140. Each camshaft 138, 140 has a sprocket 146, while the crankshaft 86 also has a sprocket 148. A timing belt or chain 150 is wound around the respective sprockets 146, 148. The crankshaft 86 therefore drives the camshafts 138, 140.

The illustrated engine 54 further includes a fuel injection system 154. The fuel injection system 154 preferably employs four fuel injectors 156 with one fuel injector allotted for each of the respective combustion chambers 80. Each fuel injector 156 has an injection nozzle that is exposed to the associated intake passage 94 such that the illustrated engine is indirectly injected. The injection nozzle preferably is opened and closed by an electromagnetic unit, such as a solenoid, which is slideable within an injection body. The electromagnetic unit generally comprises a solenoid coil, which is controlled by electrical signals. When the nozzle is opened, pressurized fuel is released from the fuel injectors 156. In the illustrated embodiment, the injection nozzle is directed toward the combustion chambers 80. Of course, in some arrangements, the fuel injectors can be disposed to inject fuel directly into the combustion chamber rather than indirectly into the combustion chamber through the induction passages. The illustrated fuel injectors 156 thus spray the fuel into the intake passages 94 during an open timing of the ports 96. The sprayed fuel enters the combustion chambers 80 with air that passes through the intake passages 94.

The fuel injection system 154 includes a fuel supply tank 160 that preferably is placed in the hull of the associated watercraft 38. In the illustrated arrangement, fuel is drawn from the fuel tank 160 by a first low pressure fuel pump 162 and a second low pressure pump 164 through a first fuel supply conduit 166. The first low pressure pump 162 preferably is a manually operated pump. The second low pressure pump 164 preferably is a diaphragm-type pump that can be operated by, for example, one of the intake and exhaust camshafts 138, 142. In this instance, the second low pressure pump 164 is mounted on the cylinder head assembly 78. A quick disconnect coupling can be provided in the first conduit 166. Also, a fuel filter 168 can be positioned in the conduit 166 at an appropriate location.

From the low pressure pump 164, fuel is supplied to a vapor separator 172 through a second fuel supply conduit 174. In the illustrated embodiment, the vapor separator 172 is mounted on the intake manifold 106. At the vapor separator end of the conduit 174, a float valve can be provided that is operated by a float 176 so as to maintain a substantially uniform level of the fuel contained in the vapor separator 172.

A high pressure fuel pump 178 is provided in the vapor separator 172. The high pressure fuel pump 178 pressurizes fuel that is delivered to the fuel injectors 156 through a delivery conduit 180. A fuel rail 182 defines a portion of the delivery conduit 180 and is mounted on the cylinder head assembly 78. The fuel rail 182 preferably supports the fuel injectors 156. The high pressure fuel pump 178 in the illustrated embodiment preferably comprises a positive displacement pump. The construction of the pump 178 thus generally inhibits fuel flow from its upstream side back into the vapor separator 172 when the pump 178 is not running. Although not illustrated, a back-flow prevention device (e.g., a check valve) also can be used to prevent a flow of fuel from the delivery conduit 180 back into the vapor separator 172 when the pump 178 is off. This later approach can be used with a fuel pump that employs a rotary impeller to inhibit a drop in pressure within the delivery conduit 180 when the pump 178 is intermittently stopped.

The high pressure fuel pump 178 is driven by a fuel pump drive motor 184 which, in the illustrated arrangement, is electrically operable and is unified with the pump 178 at its bottom portion. The drive motor 184 desirably is positioned in the vapor separator 172.

A pressure regulator 188 can be positioned along the fuel delivery conduit 180 at the vapor separator 172 and preferably limits the pressure that is delivered to the fuel injectors 156 by dumping the fuel back into the vapor separator 172.

A fuel return conduit 192 also is provided between the fuel injectors 156 and the vapor separator 126. Excess fuel that is not injected by the injector 156 returns to the vapor separator 126 through the return conduit 192.

A desired amount of the fuel is sprayed into the intake passages 94 through the injection nozzles at a selected timing for a selected duration. The injection timing and duration preferably are controlled by an ECU (electronic control unit) 194 through a control signal line 196. That is, the solenoid coil is supplied with electric power at the selected timing and for the selected duration. Because the pressure regulator 188 controls the fuel pressure, the duration can be used to determine a selected amount of fuel that will be supplied to the combustion chambers 80. Control strategies relating to the fuel injection system will be described in more detail below.

The engine 54 further includes an ignition or firing system. Each combustion chamber 80 is provided with a spark plug 200 that is connected to the ECU 194. The spark plug 200 is exposed into the associated combustion chamber 80 and ignites an air/fuel charge at a selected ignition timing. Although not shown, the ignition system preferably has an ignition coil and an igniter which are disposed between the spark plugs 200 and the ECU 194 so that an ignition timing also can be controlled by the ECU 194. In order to enhance or maintain engine performance, the ignition timing can be advanced or delayed in response to various engine running conditions. The ECU 194 and its operation will be described in greater detail below.

The ignition coil preferably is a combination of a primary coil element and a secondary coil element that are wound around a common core. Desirably, the secondary coil element is connected to the spark plugs 200 while the primary coil element is connected to the igniter. Also, the primary coil element is coupled with a power source and electrical current flows there through. The igniter abruptly cuts off the current flow in response to an ignition timing control signal and then a high voltage current flow occurs in the secondary coil element. The high voltage current flow forms a spark at each spark plug 200.

In the illustrated engine, air is introduced into the air intake passages 94 and fuel is injected by the fuel injectors 156 into the intake passages 94. The air and the fuel are mixed to form the air/fuel charge and this air/fuel charge flows into the combustion chambers 80 when the intake ports 96 are opened. The pistons 76 reciprocate between top dead center and bottom dead center. When the crankshaft 86 makes two rotations, the pistons 76 generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 76, the respective camshafts 138, 140 make one rotation. The intake camshaft 138 actuates the intake valves 98 to open the intake ports 96 during the intake stroke, while the exhaust camshaft 140 actuates the exhaust valves 126 to open the exhaust ports 124 during the exhaust stroke. Generally, at the beginning of the intake stroke, fuel is injected into the intake passage 94, and generally at the beginning of the power stroke, the spark plug 200 ignites the compressed air/fuel charge. The engine 54 continuously repeats the four strokes during operation.

During engine operation, heat builds in, for example, the cylinder block 70 and the cylinder head assembly 78. Water jackets 204 thus are provided for cooling at least these portions 70, 78. Cooling water is introduced into the water jackets 204 by a water pump 206 from the body of water surrounding the outboard motor 30 and is returned to the body of water after circulating through the cooling jackets. Thus, the engine 54 employs an open loop type cooling system.

Figure 3:
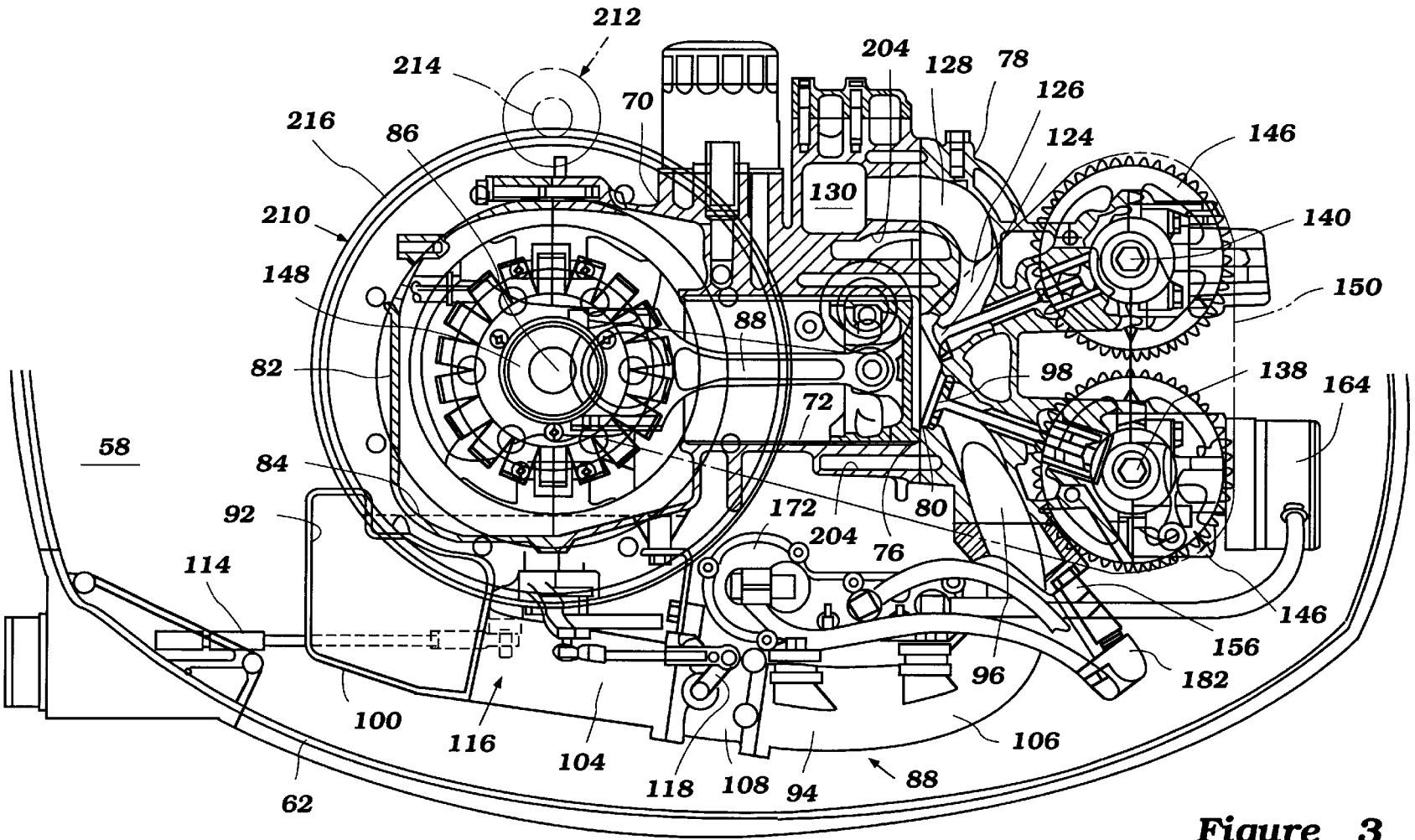
FIG. 3 is an enlarged top plan view of the power head. A top cowling member is detached and a half of a bottom cowling is omitted. A simplified view of the engine also is shown in partial section.

In the illustrated arrangement, a flywheel assembly 210 is affixed atop the crankshaft 86. The flywheel assembly 210 preferably includes an AC generator or flywheel magneto that supplies electric power to electrical components including the fuel injection system 154, the ignition system and the ECU 194. A starter motor 212 is provided for driving the crankshaft 86 to start the engine 54. As seen in FIG. 3, the starter motor 212 has a gear portion 214 that meshes with a ring gear 216 of the flywheel assembly 210. When the engine 54 starts, the starter motor 212 drives the crankshaft 68 through the gear connection. Once the engine 54 starts, however, the starter motor 212 immediately ceases operation to reduce the likelihood that the starter mechanism will be damaged.

The AC generator generates AC power and the power preferably is sent to a battery 220 placed in the hull of the watercraft 38 through a rectifier-regulator. The rectifier-regulator converts the AC power to DC power and regulates current and voltage of the power. The DC power of the battery 220 preferably is supplied to the ECU 194 through a power supply line 222 via a main switch 224. The main switch 224 has, for example, a three-position switch mechanism. The power is preferably supplied to the ECU 194 at a first position, then to heavy load equipment such as an electric motor including the fuel pump drive motor 184 at a second position, and to the starter motor 212 at a third position. The main switch 224 can be operated by the watercraft operator and can be selectively turned to any one of the positions. Moving the switch to the third position, however, starts the engine 54. The switch mechanism forcibly moves to the second position from the third position once the engine 54 has started. The main switch 224 then preferably remains in the second position under normal running conditions of the engine 54.

Figure 4:
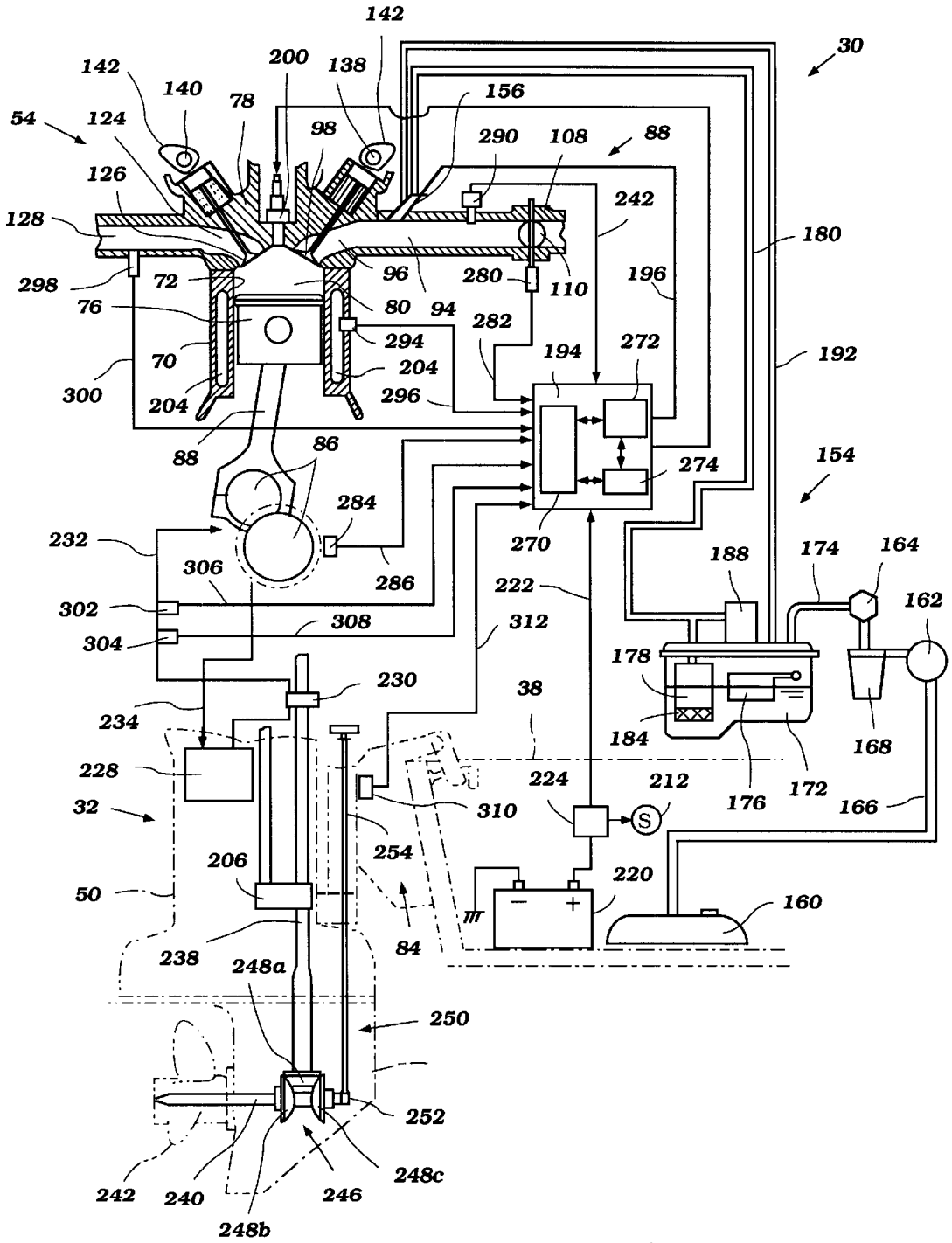
FIG. 4 is a schematic view of the outboard motor of FIG. 1. A portion of the engine is generally shown in the upper portion of the figure. A portion of the outboard motor including a driveshaft housing and a lower unit and the associated watercraft are shown in the lower portion of the figure. A control unit and a fuel injection system link together the two portions of the figure. The lower portion of the outboard motor and the watercraft are generally illustrated in phantom.

The engine 54 still further includes a lubrication system, which is rather schematically shown in FIG. 4, for lubricating certain portions of the engine 54 such as, for example, the interfaces between the connecting rods 88 and the crankshaft 86 and between the connecting rods 88 and the pistons 76. A lubricant reservoir 228 is disposed atop the driveshaft housing 50. Lubricant in the reservoir 228 is withdrawn by a lubricant pump 230 and then is delivered to the portions which need lubrication through a lubricant supply line 232. After lubricating the portions, the lubricant returns to the lubricant reservoir 228 through a lubricant return line 234 and which then repeats this circulation path. That is, the lubrication system preferably is formed as a closed loop.

The driveshaft housing 50 depends from the power head 48 and supports a driveshaft 238 which is driven by the crankshaft 86. The driveshaft 238 extends generally vertically through the driveshaft housing 50. The driveshaft 238 preferably drives the water pump 206 and the lubricant pump 230. As described above, the driveshaft housing 50 also defines internal passages which form portions of the exhaust system.

The lower unit 52 depends from the driveshaft housing 50 and supports a propulsion shaft 240, which is driven by the driveshaft 238. The propulsion shaft 240 extends generally horizontally through the lower unit 52. In the illustrated arrangement, the propulsion device is a propeller 242 that is affixed to an outer end of the propulsion shaft 240 and is driven thereby. The propulsion device, however, can take the form of a dual counter-rotating system, a hydrodynamic jet, or any of a number of other suitable propulsion devices.

A transmission 246 is provided between the driveshaft 238 and the propulsion shaft 240. The transmission 246 couples together the two shafts 238, 240 which lie generally normal to each other (i.e., at a 90° shaft angle) with bevel gears 248*a*, 248*b*, 248*c*. The outboard motor 30 has a switchover or clutch mechanism 250 that allows the transmission 246 to shift the rotational direction of the propeller 242 among forward, neutral or reverse.

In the illustrated arrangement, the switchover mechanism 250 includes a shift cam 252, a shift rod 254 and a shift cable 256. The shift rod 254 extends generally vertically through the driveshaft housing 50 and the lower unit 52. The shift cable 256 extends through the bottom cowling member 62 and then forwardly to a manipulator which is located next to a dashboard in the associated watercraft 38. The manipulator has a shift lever which is operable by the watercraft operator.

The lower unit 52 also defines an internal passage that forms a discharge section of the exhaust system, as discussed above. At engine speed above idle, the majority of the exhaust gases are discharged to the body of water surrounding the outboard motor 30 through the internal passage and finally through an outlet passage defined through the hub of the propeller 242. Of course, an above-the-water discharge can be provided for lower speed engine operation.

With reference now to FIG. 4, the ECU 194 preferably comprises a CPU (central processing unit) chip 270, memory or storage chips 272 and a timer or clock chip 274 which are electrically coupled together within a water-tight, hard box or container. The box containing the ECU 194 is mounted on an outer surface of the engine 54 or disposed at any appropriate location in the cavity 58. The respective chips preferably are formed as an LSI (large scaled integrated circuit) and can be produced in a conventional manner. The timer chip 274 can be unified with the CPU chip. The memory chips 272 preferably include at least one ROM (read only memory), at least one RAM (random access memory) and at least one EEPROM (electrical erasable programmable ROM).

The ROM is a non-volatile memory and stores the most basic control programs that can not be erased. The programs include various control routines, such as those discussed below.

The RAM is a volatile memory and stores programs and data that are erasable and rewriteable. The RAM preferably stores at least one control map, which can be three-dimensional in some arrangements. The control map preferably has a horizontal axis designating throttle opening degrees (Km), a vertical axis designating engine speeds (Cn) and squares designating amounts of fuel (Amn) corresponding to both the throttle opening degrees (Km) and the engine speeds (Cn). The respective fuel amounts can be determined to provide an optimal air/fuel ratio in any combination of the throttle opening (Km) and the engine speed (Cn). Of course, less than optimal numbers can be used, where desired. The preferred RAM also can store an adjustment map that contains a relationship between atmospheric pressures and adjustment coefficients of fuel amounts. In the adjustment map, one atmospheric pressure corresponds to one adjustment coefficient. The higher the atmospheric pressure, the greater the specific gravity of air. The adjustment coefficients therefore become greater with increase of the atmospheric pressures. The RAM further stores an engine speed data that is used for determining whether the engine 54 has started. The ECU 194 preferably determines that the engine 54 has started when the engine speed reaches 100 rpm. The engine start can be determined by other engine speeds such as 50 rpm and 150 rpm.

The EEPROM is basically a non-volatile memory but at least in part the data stored therein can be erased and rewritten. In the illustrated arrangement, the EEPROM preferably stores an intake pressure as an atmospheric pressure at which the ECU 194 is been turned on while the engine 54 stands still. More specifically, when the main switch 224 is in the first or second position but the starter motor 212 has not yet operated, i.e., the main switch 224 has not turned onto the third position, then the EEPROM stores the sensed intake pressure as a proxy for atmospheric pressure. The EEPROM is the most suitable non-volatile memory. However, other memory elements that have the non-volatile nature can of course applicable in practicing embodiments of the present invention.

As described above, the preferred ECU 194 stores a plurality of control maps or equations related to various control routines. In order to determine appropriate control indexes in the maps or to calculate them using equations based upon the control indexes determined in the maps, various sensors are provided for sensing engine conditions and other environmental conditions.

Figure 5:
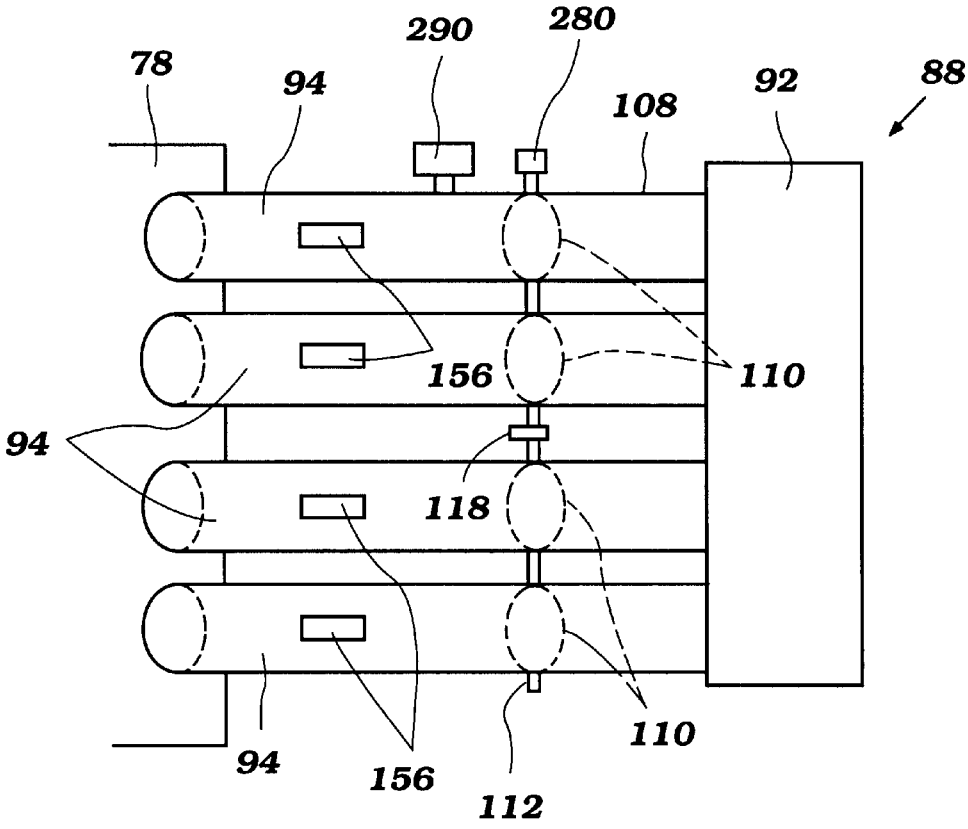
FIG. 5 is a schematic view of at least a portion of an air induction system that is associated with the engine of FIG. 1.

With primarily reference to FIG. 4 and additionally reference to FIGS. 2 and 5, a throttle valve position sensor 280 is provided proximate the valve shaft assembly 112 to sense an opening degree or opening position of the throttle valves 110. A sensed signal is sent to the ECU 194 through a sensor signal line 282. Of course, the signals can be sent through hard-wired connections, emitter and detector pairs, infrared radiation, radio waves or the like. The type of signal and the type of connection can be varied between sensors or the same type can be used with all sensors. The sensed signal also can be used to determine a rate of change of the throttle valve position.

Associated with the crankshaft 86 is a crankshaft angle position sensor 284 which, when measuring crankshaft angle versus time, outputs a crankshaft rotational speed signal or engine speed signal that is sent to the ECU 194 through a sensor signal line 286, for example. The sensor 284 preferably comprises a pulsar coil positioned adjacent to the crankshaft 86 and a projection or cut formed on the crankshaft 86. The pulsar coil generates a pulse when the projection or cut passes proximate the pulsar coil. In some arrangement, the number of passes can be counted. The sensor 284 thus can sense not only a specific crankshaft angle but also a rotational speed of the crankshaft 86. Of course, other types of speed sensors also can be used.

An air intake pressure sensor 290 is positioned along one of the intake passages 94, preferably at the uppermost intake passage 94, at a location downstream of the throttle valve 110. The intake pressure sensor 290 primarily senses the intake pressure in this passages 94 during engine operation. The sensed signal is sent to the ECU 194 through a sensor signal line 292, for example. This signal can be used for determining engine load. In the illustrated arrangement, the sensor 290 also senses air pressure before the engine 54 starts. The sensed pressure can be a fairly accurate proxy for the atmospheric air pressure.

A water temperature sensor 294 at the water jacket 204 sends a cooling water temperature signal to the ECU 194 through a sensor signal line 296, for example. This signal represents engine temperature.

An oxygen ($O_2$) sensor 298 senses oxygen density in exhaust gases. The sensed signal is transmitted to the ECU 194 through a sensor signal line 300, for example. The signal represents air/fuel ratio and helps determine how complete combustion is within the combustion chambers.

The lubrication system has a lubricant temperature sensor 302 and a lubricant pressure sensor 304 at the lubricant supply line 232. The sensed signals are sent to the ECU 94 through a sensor signal line 306 and a sensor signal line 308, respectively, for example.

A shift position sensor 310 sends a signal indicating a position of the shift rod 254 (forward, neutral or reverse) to the ECU 194 through a sensor signal line 312, for example. With primarily reference to FIGS. 6–8 and still reference to FIGS. 4, a control of the fuel injection system 154 by the ECU 194 will now be described below. Other controls and operations, which are of course simultaneously practiced, will be omitted in this description. In addition, it should be recognized that the control system can be stored as software and executed by a general purpose controller, can be hardwired, or can be executed by a devoted controller.

Figure 7:
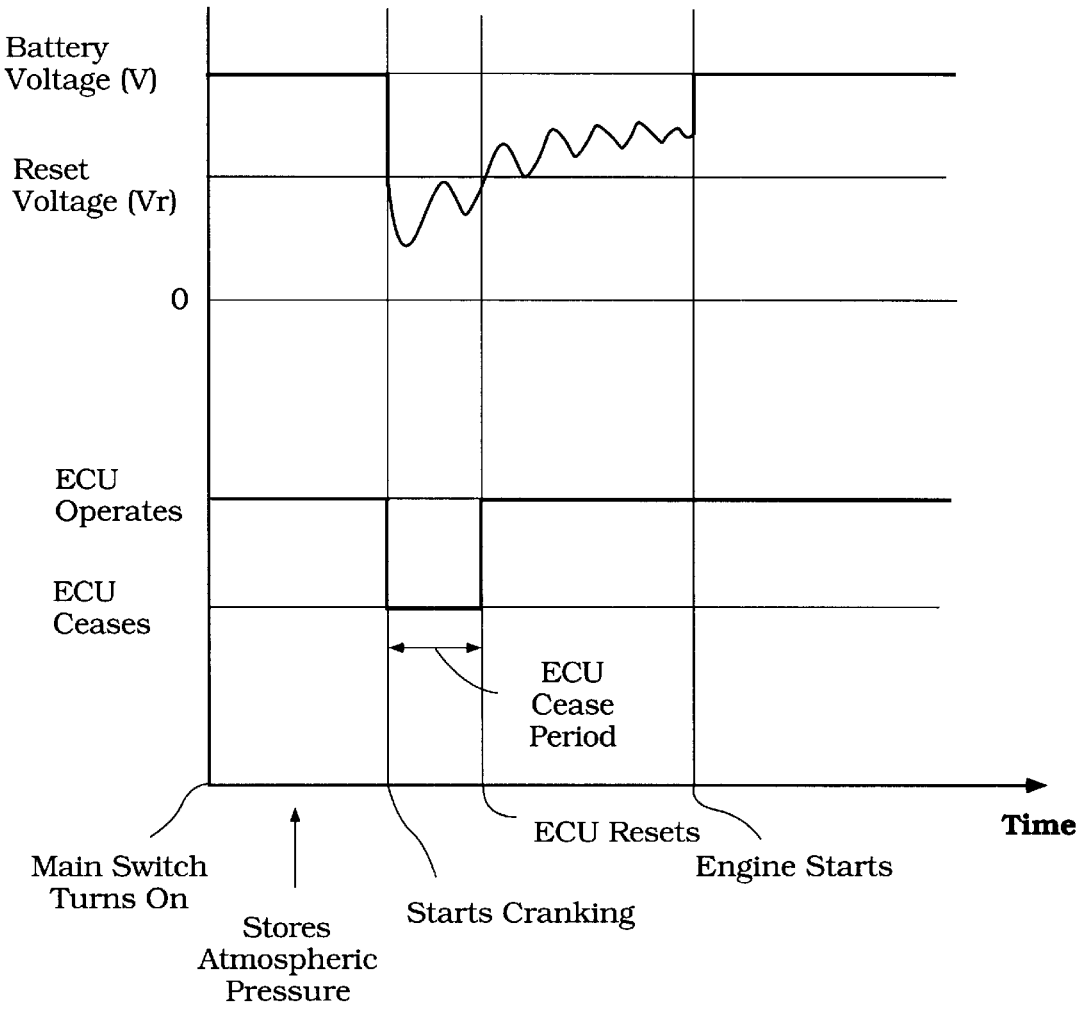
FIG. 7 is a timing chart diagram of a start up condition of the engine.

FIG. 7 illustrates a time chart showing several states of the battery 220 and the ECU 194 over time.

When the illustrated main switch 224 is turned on and kept at least in the first position, a voltage of the battery 220 is greater than a reset voltage Vr of the ECU 194. The ECU 194 therefore starts operation and stores an atmospheric pressure that is sensed by and sent from the intake pressure sensor 290 in the EEPROM of the ECU 194.

When the operator turns the main switch 224 toward the third position, the starter motor 212 starts cranking, i.e., driving the crankshaft 86. Due to the actuation of the starter motor 212, a large amount of power is consumed, particularly when the starter motor is initially actuated, and the voltage of the battery 220 may falls to a level lower than the reset voltage Vr of the ECU 194. Immediately after this moment, the voltage recovers to a higher level than the reset voltage Vr. The ECU 194, however, ceases operation during the period of time when the battery voltage is lower than the reset voltage Vr. Stored data in the RAM can be lost at this time. However, because the atmospheric pressure signal or data that is stored in the EEPROM (i.e., the non-volatile memory), the data is not lost and is held so long as the main switch 224 is not turned off.

The starter motor 212 continues cranking and the engine 54 eventually starts. With the engine start, the starter motor 212 stops. The starter motor may automatically stop or disengage or the operator may release the starter switch when the engine starts. The battery 220 thus recovers the initial voltage. All electrical equipment, including the ECU 194, then is operational after the engine starts because the main switch 224 stays in the second position.

Figure 8:
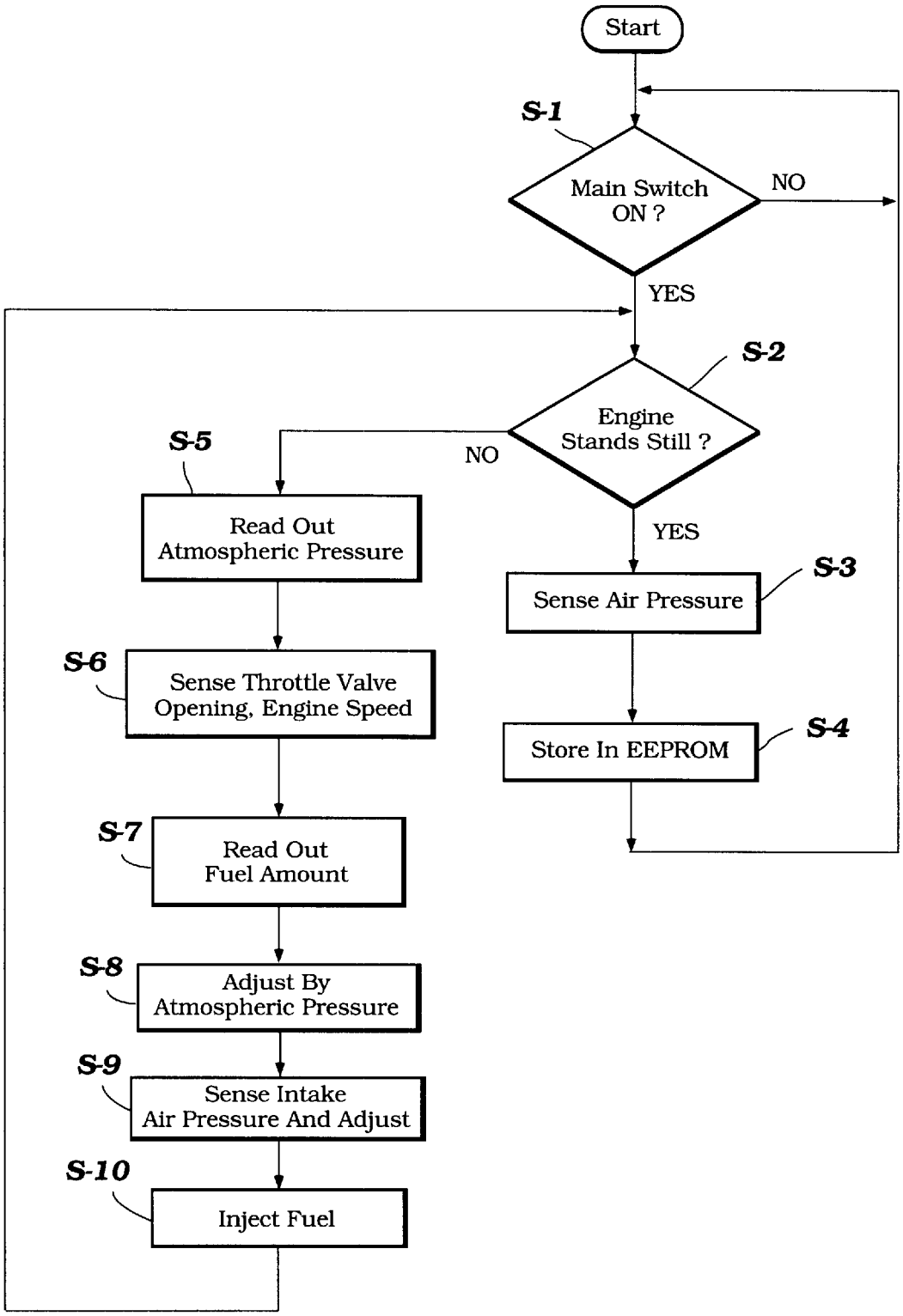
FIG. 8 is a control routine configured in accordance with certain features, aspects and advantages of the present invention.

FIG. 8 illustrates a control routine of the fuel injection system 154 having certain features, aspects and advantages of the present invention and that can be practiced by the ECU 194.

The control routine should not be interpreted as showing an actual control program but should be recognized as showing a control method configured in accordance with certain features, aspects and advantages of a preferred embodiment of the present invention. In the illustrated arrangement, the ECU 194 generally practices this routine except for the Step 1 which is performed before the ECU 194 itself has been switched on.

In the illustrated arrangement, an amount of fuel sprayed by the fuel injectors 156 is determined so that the fuel amount injected corresponds to an amount of air supplied through the intake passages 94. The airflow passed the throttle valves 110 varies in proportion to an atmospheric pressure. The throttle valve position sensor 280, however, does not sense the actual air amount but merely the valve position. Accordingly, an adjustment of the fuel amount by an adjustment coefficient of the atmospheric pressure is desired to enhance engine performance. Accordingly, the control routine determines the atmospheric pressure and adjusts the injected fuel amount with an adjustment coefficient reflecting this atmospheric pressure.

The control routine begins and it is determined whether the main switch 224 is turned on, i.e., the switch 224 is in the first or second position (see S-1). If the switch 224 is not in a first or second position (i.e., in an on position), then the routine continues to monitor the switch position until the switch is turned on. If the switch is turned on, and when the switch is in the first or second position, the controller determines whether the engine 54 has started (see S-2). As described above, in this arrangement, if the engine speed is less than 100 rpm, the program determines that the engine 54 has not started. The chosen speed is not important. Preferably, the speed is selected to be zero such that the engine is not drawing air through the induction system.

If the engine has not started, the controller takes an intake pressure signal sensed by the intake pressure sensor 290, for instance (see S-3). This intake pressure represents an atmospheric pressure because the air pressure in the intake passage 94 under this condition is equal to the atmospheric pressure. After the engine has been cranked, the pressure will begin to drop as air is pulled into the combustion chambers. The sensed atmospheric pressure data is then stored in the EEPROM (see S-4).

If then engine is operating, i.e., the engine speed exceeds 100 rpm, then the data reflecting the atmospheric pressure is read from memory in the EEPROM (see S-5). Of course, the engine speed selected is not important. Preferably, the selected engine speed is a speed at which the engine can sustain operation on its own. More preferably, the selected engine is a speed that is higher than an input power source, such as the starter motor, causes and is lower than the speed at which the engine can sustain power on its own. Then, the controller senses a throttle valve opening position (i.e., reads the signal output by the throttle valve position sensor 280) and senses an engine speed (i.e., reads the signal output by the crankshaft angle position sensor 284) (see S-6).

The controller then determines an amount of fuel (Amn) that should be injected based upon the throttle valve opening degree (Km) and the engine speed (Cn) from a control map, such as that shown in FIG. 6, for instance (see S-7). Next, the controller adjusts the fuel amount (Amn) based upon the sensed atmospheric pressure (see S-8). As described above, the atmospheric pressure data preferably is converted into an adjustment coefficient for the fuel amount and can be contained in an adjustment map. The adjustment amount can thus be calculated by multiplying the adjustment coefficient and the selected fuel amount (Amn) together. Of course, other correction techniques can be used.

The controller then again samples an intake pressure (i.e., reads a signal output by the intake pressure sensor 290) (see S-9). Because the engine is now operational, the sensed signal is a current intake pressure. The controller then can fine tune the fuel amount with an adjustment coefficient corresponding to the intake pressure. This correction is desired because the fuel injection system 154 generally maintains the fuel pressure in the fuel supply system at a preset constant value using the pressure regulator 188 as noted above. If the intake pressure fluctuates, the difference between the fuel pressure and the intake pressure varies and the fuel amount sprayed per unit time also varies. The adjustment based upon the current intake pressure therefore can further improve engine performance. If, however, the intake pressure does not fluctuate greatly, then the adjustment can be skipped in some arrangements. The current intake pressure data is preferably stored in the RAM and thus can be renewed with a new intake pressure data that will be taken in subsequent passes through the control routine.

The controller then sends a control signal to the fuel injectors 290 (see S-10). The fuel injectors 156 hence spray the amount fuel that has been finally adjusted. Actually, in the illustrated arrangement, the fuel injectors 156 open for a determined time period such that they spray the determined amount of fuel because the fuel pressure is generally constant as noted above.

As described above, in the illustrated arrangement, the atmospheric pressure determined while the engine 54 is not operational is stored in the EEPROM, which is a non-volatile memory. This data preferably is not overwritten by current intake pressure data while the ECU 194 continues to operate. When the ECU 194 stops operating, i.e., the main switch 224 is turned off, then the stored atmospheric pressure data is erased. A new sensed intake pressure can be stored as a new atmospheric pressure when the main switch 224 is again turned on before the engine is cranked. Accordingly, an accurate atmospheric pressure data can always be stored in the ECU 194 during and after starting of the engine notwithstanding using an intake pressure sensor 290 as an atmospheric pressure sensor. In other words, the conventional atmospheric pressure sensor can be eliminated without causing any errors in determining the fuel amount.

Whether the engine is cranking or not can be determined by other methods than the method using the engine speed. For instance, the intake pressure under the cranking condition is lower than a preset pressure which is, for example, approximately 0.9 atm. It is therefore practicable to sense the intake pressure and to determine that the engine has started if the intake pressure is greater than 0.9 atm. That is, if the intake pressure is greater than 0.9, then the program may store the sensed intake pressure as the atmospheric pressure for control.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Some of the steps of the illustrated control routine can be combined, split or otherwise manipulated. Additionally, some of the steps can be reordered in manners that will be apparent to those of ordinary skill in the art. Furthermore, the overall routine could be completed using several subroutines in a combined manner, for instance. Accordingly, the scope of the present invention is intended to be defined only by the claims that follow.

What is claimed is:

1. An internal combustion engine comprising a cylinder block defining at least one cylinder bore, a piston reciprocating within the cylinder bore, a cylinder head closing an end of the cylinder bore to define a combustion chamber together with the cylinder bore and the piston, an air induction system arranged to introduce air to the combustion chamber, the air induction system including an air intake passage, a throttle valve moveably disposed within the air intake passage for admitting the air in proportion to an opening degree thereof, a first sensor arranged to sense the opening degree so as to send out an opening degree signal, a fuel injector arranged to spray fuel toward the combustion chamber, a control unit configured to determine an amount of the fuel at least based upon the opening degree signal, and a second sensor primarily arranged to sense an intake pressure of the air flowing through the air intake passage so as to send out an intake pressure signal, the second sensor positioned downstream the throttle valve, the control unit adjusting the amount of the fuel based upon a reference signal corresponding to an atmospheric pressure, and the control unit including a non-volatile memory for storing the intake pressure signal as the reference signal, the control unit storing the intake pressure signal when the control unit starts operating and the piston is not moving at a speed equal to or above that necessary to start the engine.

2. The internal combustion engine as set forth in claim 1, wherein the control unit further adjusting the amount of the fuel based upon a current intake pressure signal sent from the second sensor when the piston moves at a speed above that necessary to start the engine.

3. The internal combustion engine as set forth in claim 1 comprising a third sensor arranged to sense an engine speed so as to send out an engine speed signal, wherein the control unit determines the amount of the fuel further based upon the engine speed signal.

4. The internal combustion engine as set forth in claim 3 additionally comprising a crankshaft journaled for rotation by the reciprocal movement of the piston, wherein the third sensor senses a rotational speed of the crankshaft.

5. The internal combustion engine as set forth in claim 1, wherein the air intake passage communicates with the combustion chamber through a valve port, and an intake valve repeatedly opens and closes the valve port when the piston moves.

6. The internal combustion engine as set forth in claim 1, wherein the reference signal stored in the non-volatile memory is erased when the control unit is turned off.

7. The internal combustion engine as set forth in claim 1, wherein EEPROM defines the non-volatile memory.

8. The internal combustion engine as set forth in claim 1, wherein the engine powers a marine propulsion device.

9. The internal combustion engine as set forth in claim 1, wherein the fuel injector injects fuel into said air intake passage such that the fuel is indirectly injected into the combustion chamber.

10. An internal combustion engine comprising a cylinder block defining at least one cylinder bore, a piston reciprocating within the cylinder bore, a cylinder head closing an end of the cylinder bore to define a combustion chamber together with the cylinder bore and the piston, an air induction system arranged to introduce air to the combustion chamber, the air induction system including an air intake passage, a throttle valve moveably disposed within the air intake passage for admitting air in proportion to an opening degree thereof, a first sensor arranged to sense the opening degree so as to send out an opening degree signal, a fuel injector arranged to spray fuel toward the combustion chamber, a control unit configured to determine an amount of the fuel at least based upon the opening degree signal, and a second sensor primarily arranged to sense an intake pressure of the air flowing through the air intake passage so as to send out an intake pressure signal, the second sensor positioned downstream the throttle valve, the control unit adjusting the amount of the fuel based upon a reference signal corresponding to an atmospheric pressure, and the control unit including a storage device that stores the intake pressure signal as the reference signal, the control unit storing the intake pressure signal when the control unit starts operating and the engine speed is below a preset engine speed.

11. A control method for an engine including a fuel injector, an air intake passage having a throttle valve, and a control unit having a non-volatile memory, comprising sensing an air pressure in the intake passage under a substantially standstill condition of the engine, storing a signal of the air pressure in the non-volatile memory, sensing an opening degree of the throttle valve under an operating condition of the engine, determining a first control signal at least based upon a signal of the opening degree, adjusting the first control signal with a second control signal corresponding to the signal of the air pressure stored in the non-volatile memory, and controlling the fuel injector based upon the adjusted first control signal.

12. The control method as set forth in claim 11 additionally comprising sensing a current air pressure in the intake passage under the operating condition of the engine, and further adjusting the first control signal with a third control signal corresponding to a signal of the current air intake pressure.

13. The control method as set forth in claim 11 additionally comprising sensing an engine speed, wherein the first control signal is determined further based upon a signal of the engine speed.

14. The control method as set forth in claim 11, wherein an amount of fuel sprayed by the fuel injector is controlled based upon the adjusted first control signal.

15. An internal combustion engine comprising an engine body, a moveable member moveable relative to the engine body, the engine body and the moveable member together defining a combustion chamber, an air induction system arranged to introduce air to the combustion chamber, a charge forming device arranged to supply fuel to the combustion chamber, a control unit configured to determine an amount of the fuel, and a sensor configured to sense an air pressure within the air induction system, the control unit storing a signal of the sensor when the engine is at or substantially at a standstill, the control unit adjusting the amount of the fuel by using the signal as a reference signal when the engine operates.

16. The engine as set forth in claim 15, wherein the control unit comprises a non-volatile memory to store the signal.

17. The engine as set forth in claim 15 additionally comprising a second sensor configured to sense an amount of the air, the control unit primarily determining the amount of the fuel based upon at least a signal of the second sensor.

18. The engine as set forth in claim 15 additionally comprising a second sensor configured to sense an engine speed, the control unit primarily determining the amount of the fuel based upon at least a signal of the second sensor.

19. The engine as set forth in claim 18, wherein the control unit stores a critical engine speed, the control unit determines that the engine is substantially at a standstill when the signal of the second sensor is less than the critical engine speed.

20. A control method for an engine comprising determining an amount of fuel supplied to the engine, sensing an air pressure in an air induction system of the engine when the engine is at or substantially at a standstill, storing the air pressure in a non-volatile memory, and adjusting the amount of the fuel by using the stored air pressure as a reference when the engine operates.

21. The control method as set forth in claim 20 additionally comprising sensing an amount of the air, the sensed amount of the air is used to determine the amount of the fuel.

22. The control method as set forth in claim 20 additionally comprising sensing an engine speed, the sensed engine speed is used to determine the amount of the fuel.

23. The control method as set forth in claim 22 additionally comprising determining that the engine is substantially at a standstill when the sensed engine speed is less than a preset engine speed.

24. An internal combustion engine comprising an engine body defining at least one combustion chamber therein, an air induction system arranged to supply air to the combustion chamber, the air induction system including an air intake passage, a throttle device disposed within the air intake passage to regulate air flow into the combustion chamber, an air pressure sensor arranged with the air intake passage downstream of the throttle device, at least one fuel injector supplying fuel to the combustion chamber, and a controller that controls the operation of the fuel injector and that includes memory, the controller receiving a signal from the air pressure sensor before the engine starts that is indicative of atmospheric air pressure and stores the sensed atmospheric air pressure in memory, the controller also receiving a signal from the air pressure sensor after the engine starts that is indicative of a momentary air pressure within the air intake passage as the engine is running, the controller configured to determine an amount of fuel to be supplied to .the-combustion chamber based upon the sensed momentary air pressure within the air intake passage and upon the stored atmospheric air pressure.

* * * * *